US005588340A

United States Patent [19]

Hancock

[11] Patent Number: 5,588,340

[45] Date of Patent: Dec. 31, 1996

[54] HAND HELD IMPLEMENT SHARPENING DEVICE

[75] Inventor: Dennis H. Hancock, Mt. Green, Utah

[73] Assignee: All Rite Products, Inc., Mt. Green, Utah

[21] Appl. No.: 404,169

[22] Filed: Mar. 14, 1995

[51] Int. Cl.[6] ..... B24D 13/06

[52] U.S. Cl. ..... 76/82; 451/461; 451/557

[58] Field of Search ..... 76/82, 82.1, 82.2, 76/83, 84, 85, 88; 2/120; 30/138, 297, 329, 342, 343; 451/461, 557, 558

[56] References Cited

U.S. PATENT DOCUMENTS 1,617,592 2/1927 Hardy ..... 451/557
1,728,619 9/1929 Lambert ..... 30/343
3,956,858 5/1976 Catlin et al. ..... 451/557
4,418,588 12/1983 Byers ..... 76/82.2

*Primary Examiner*—Douglas D. Watts
*Attorney, Agent, or Firm*—Thorpe, North & Western

[57] ABSTRACT

A device for sharpening the blade or blade-like surfaces of knifes or other implements. The device is a small hand held sharpening device which provides rigidity and stability of the sharpening edge during use. The sharpening device employs a notched plate which interacts with the housing material surrounding the plate to resist the forces, present during use, which tend to urge the sharpening edge to move. By utilizing this design, the amount of material required for the housing material which surrounds the plate is minimized. Minimal housing allows the sharpening device to be particularly maneuverable in small areas. Minimal housing material, as well as ergonomic design, also allow for ease of use of the sharpening device.

17 Claims, 2 Drawing Sheets

HAND HELD IMPLEMENT SHARPENING DEVICE

BACKGROUND

1. The Field of the Invention

This invention relates generally to devices for sharpening the blades or blade-like edges of knives, scissors, and other implements. More specifically, this invention relates to small, light weight, hand held devices which provide for sharpening and deburring of the blades or blade-like edges of a variety of implements.

2. The Background Art

Devices for the sharpening and deburring of blades and blade-like edges of implements have been in use since the advent of metal implements. Historically, sharpening devices were cumbersome and required semi-permanent installation. This, in turn, meant that sharpening devices were effectively restricted to a permanent location.

As materials and technology progressed, smaller sharpening devices developed. The discovery of materials which could be processed to have extremely hard sharpening surfaces aided in these advancements. These materials allowed for sharpening devices which could employ a small sharpening surface.

The development of hand held sharpening devices soon followed. The ability to employ a small sharpening surface allowed for the development of small sharpening devices and led naturally to hand held versions. These devices provided portability not previously available.

With the advent of modern materials, having extremely hard surfaces, hand held sharpeners have become relatively common place. A wide variety of such devices have developed. These range from large devices to pocket size devices. These typically employ extremely hard materials as sharpening surfaces.

Hand held sharpeners utilizing an extremely hard sharpening surface provide exceptional sharpening abilities in a small device. These modern materials do, however, have certain drawbacks. For example, extremely hard materials are often quite expensive. It can also be expensive to polish these materials into a sharpening surface.

These modern extremely hard materials also have certain advantages in addition to providing an exceptional sharpening surface when processed and polished. For example, certain materials, when processed, have a natural texture. This texture provides an excellent deburring surface in its unpolished state.

An example of a hand-held device would include a blade holder and a blade or sharpening surface at the other. The blade holder typically includes an area which the user grips during use. The sharpening surface usually is created by exposing a polished edge or edges of material which act as a blade. This blade is used for sharpening.

During use, forces are placed upon the blade such that the blade tends to try to move with regard to the handle. In order to have adequate stability, therefore, such sharpeners often employ a relatively large quantity of housing material surrounding the sharpening edge. This quantity of material can hamper the usefulness of the sharpening edge by preventing maneuvering of the blade in tight areas or by interfering with use of the blade during the sharpening operation.

It would therefore be an advantage in the art to provide a small hand held sharpener which employed a minimal amount of housing material surrounding the blade or sharpening surface while at the same time achieving adequate stability.

BRIEF SUMMARY AND OBJECTS OF THE INVENTION

The present invention is a device for sharpening knives, implements or other devices having a blade or blade-like surface. The sharpening device includes a handle and a plate having sharpening surfaces or edges.

In a preferred embodiment, the plate is manufactured of tungsten carbide and is rectangular in shape. The short sides of the rectangle are notched while the long sides of the rectangle provide the sharpening surfaces. Preferably, one of the long sides or edges is left as is or only partially refined so as to provide a deburring surface while the other long side or edge is refined so as to provide a sharpening surface.

The plate is partially enclosed within the material of the handle such that the notched edges are enclosed while the long edges are exposed so as to be available for use in sharpening. The notches in the plate provide a butterfly shape which interacts with the material of the handle to resist the forces, present during use, which tend to force the plate to move with respect to the handle.

The sharpening edges of the plate of the inventive device will come in contact with a knife or implement blade during use of the inventive sharpening device. During such use, the plate will be urged to shift or give with relation to the handle. The notches in the plate, enclosed with the plastic material of the handle serve to greatly reduce or eliminate the ability of the plate to move with relation to the handle. Thus, the plate remains substantially stable during use of the sharpening device of the present invention.

The handle is preferably manufactured of a plastic material which is formed partially around the plate. As discussed above, the plastic of the material interacts with the notches or butterfly shape of the plate in such a way as to provide stability of the plate during use of the sharpening edges. Plastic is particularly advantageous in this regard as it can be easily molded to conform to the shape of the plate.

Accordingly, it is a primary object of the present invention to provide a small lightweight sharpening device having a stable sharpening edge or edges.

It is a further object of the present invention to provide a sharpening device which requires minimal material for entrapping the blade.

A still further object of the invention is to provide a sharpening device which can be maneuvered in tight areas.

These and other objects of the present invention will become apparent from the following description and appended claims or may be learned by the practice of the invention as set forth herein.

BRIEF DESCRIPTION OF THE DRAWINGS

In order to more fully understand the manner in which the above-recited and other advantages and objects of the present invention are obtained, a more particular description of the invention briefly described above will be rendered by reference to the presently understood best mode for making and using the same, as illustrated in the appended drawings. Understanding that these drawings depict only typical embodiments of the invention and are, therefore, not to be considered as limiting of its scope, the invention will be described with additional specificity and detail through the use of the accompanying drawings in which.

DETAILED DESCRIPTION OF THE PREFERRED EMBODIMENTS

Figure 1:
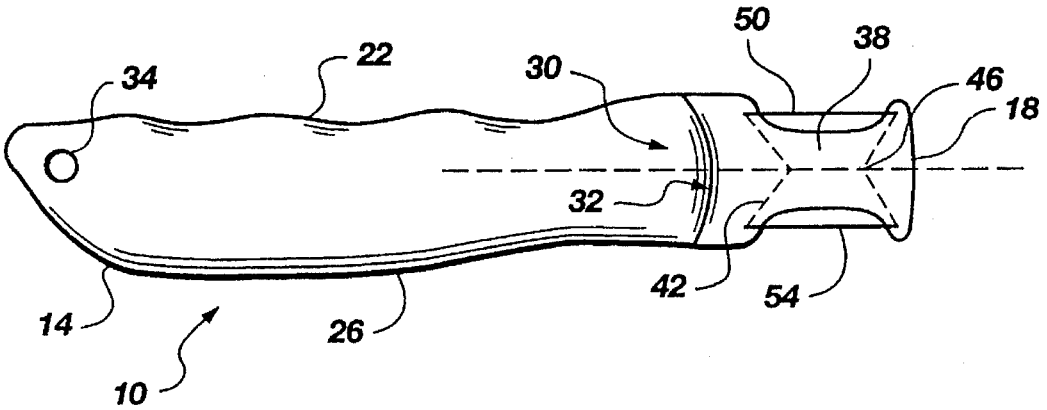
FIG. 1 is a top view of the inventive implement sharpening device.

Reference is now made to the embodiments illustrated in FIGS. 1 through 4 wherein like numerals are used to designate like parts throughout. FIG. 1 depicts a top view of the preferred embodiment of the inventive sharpening device shown generally at 10. As shown, the inventive sharpening device includes a handle end 14 and an engagement end 18.

Handle end 14 and engagement end 18 collectively form the body of the device. The body of the device is preferably manufactured of a plastic material. The plastic material will typically not be entirely rigid but rather have some minimal flexibility. It is contemplated, however, that any plastic which can withstand the forces applied during use of the device for sharpening would be acceptable. Additionally, other materials such as metal or wood may be used.

Ridges 22, curved portion 26, and dished area 30 are also illustrated in handle end 14. Ridges 22, curved portion 26, dished area 30, and raised ridge 32 are ergonomically designed to provide a comfortable grip for the user of sharpening device 10. As will be appreciated, in some instances the effectiveness of sharpening device 10 will depend in part on the ability to apply controlled force to sharpening device 10. The ability to control the force applied between sharpening device 10 and the blade of the knife or implement to be sharpened can effect the quality of sharpening accomplished. By providing ridges 22 to act as finger grips, curved portion 26 to better fit the contours of the palm of the users hand, and dished area 30 and raised ridge 32 to provide a thumb brace for the thumb of the user, the control of the user over the force applied is optimized.

Additionally, providing finger grips, palm contouring and a thumb brace in handle end 14 allows for added comfort in the use of sharpening device 10. If the surface is left flat, without ridges, it is more difficult for the user to grip. The user may, in fact, be required to use additional force to adequately grip sharpening device 10. This may result in discomfort and cramping, particularly in extended use of sharpening device 10. Incorporation of ridges 22, curved portion 26, dished area 30, and raised ridge 32 so as to provide a comfortable gripping surface can extend the amount of time a user can employ sharpening device 10 in relative comfort.

Also incorporated in handle end 14 of sharpening device 10 is a circular opening 34. Circular opening 34 may be used in a number of ways. Circular opening 34 allows for sharpening device 10 to be included on a key ring, hung on a tool organizer, attached to a work bench, or may provide other means for keeping sharpening device 10 in a certain vicinity. Typically a small diameter cord or chain (not shown) would be placed through circular opening 34. In this way, sharpening device 10 could be attached to a key ring, tool organizer, work bench, or other area. For example, it is shown in FIG. 1 that the plate 38 is entrapped as described, in that the notches 42 and 46 are embedded within the body of the device 10 such that portions of the body extend into the notches so as to hold the plate 38 in its rigid position with respect to the body, providing the interaction between the notches and the body as noted above. The notches 42 and 46 are preferably V-shaped and are respectively formed in proximal and distal ends of the plate 38 as shown, but may of course comprise other shapes as well. The plate 38 is thus enclosed within the body in such a manner that the body circumscribes the plate around the proximal and distal ends in which the notches 42 and 46 are respectively formed, such that at least a majority of the distal end 46 is covered by the body of the device 10 as shown in FIG. 1.

Turning to engagement end 18, plate 38 is shown partially disposed within the body of sharpening device 10 at engagement end 18. Plate 38 is preferably made of tungsten carbide material, however, it is contemplated that plate 38 could be manufactured of other materials. For example, in certain sharpening applications, the quality of the edge achieved may be less critical and the price of the sharpening device may be of great concern. In such instances, a material which is less effective than tungsten carbide in sharpening but which is less expensive may be suitable.

As illustrated, plate 38 is generally rectangular in shape and is manufactured with a handle end notch 42 and an engagement end notch 46 along the short edges of the rectangle. It is contemplated that plate 38 could be manufactured other than generally rectangular without departing from the scope of the present invention. Any geometric shape which would allow for notches and sharpening edges would be acceptable.

The notches in plate 38 are designed to interact with the material of the body of sharpening device 10 so as to resist the forces applied to sharpening device 10 when in use. In this way, a stable sharpening surface is provided with a minimal amount of material acting to entrap plate 38 at engagement end 18 of sharpening device 10.

Additionally, incorporating notches minimizes the amount of material used in plate 38. Tungsten carbide is a relatively expensive material thus costs may be contained by minimizing the amount of tungsten carbide required. Tungsten carbide is a material which must undergo a manufacturing process to become useful as a hardened sharpening surface. In creating plates for use in sharpening, the notched rectangular plates may be fashioned from tungsten carbide plate prior to submitting the material to the hardening process. In this way, the material cut away to form the notches can be reused. This minimizes the amount of material used in manufacturing each sharpening device and thus reduces the costs.

Plate 38 also incorporates sharpening edge 50 and deburring edge 54 along the long sides of the rectangle of plate 38. Sharpening edge 50 is manufactured by further refining sharpening edge 50. Deburring edge 54 is typically simply left as is since deburring requires a less polished surface, and tungsten carbide naturally provides a surface suitable for deburring when cut. If desired, the deburring edge may be further refined to provide a more polished surface however, this adds to the costs associated with producing sharpening device 10.

When further refined or polished, tungsten carbide provides an extremely hard high quality sharpening surface. This surface is exposed in sharpening edge 50. As depicted, sharpening edge 50 is along the same side of sharpening device 10 as ridges 22. As will be appreciated, placing sharpening edge 50 along this side of sharpening device 10 provides for greatest control during sharpening. This is preferable since it will typically be the users desire to have as much control as possible during sharpening while being less concerned about the degree of control during the less precise activity of deburring.

When sharpening device 10 is in use, either sharpening edge 50 or deburring edge 54 contact the blade or blade-like surface of an implement requiring sharpening. Typically a user of the sharpening device of the present invention will first employ deburring edge 54 to remove large anomalies on the blade or blade-like surface of the implement. A user of the sharpening device of the present invention will then employ sharpening edge 50 so as to accomplish the final sharpening of the blade or blade-like surface of the implement.

As will be appreciated, either of these operations applies forces to plate 38. The forces applied will tend to cause plate 38 to rotate or move in some fashion with relation to the body of sharpening device 10.

Handle end notch 42 and engagement end notch 46 resist such motion. The interaction of the notches and the material of the body of sharpening device 10 provide significant resistance to motion. Thus, the amount of material required to enclose plate 38 is minimized while at the same time providing the stability and rigidity necessary for proper use of sharpening device 10.

Figure 2:
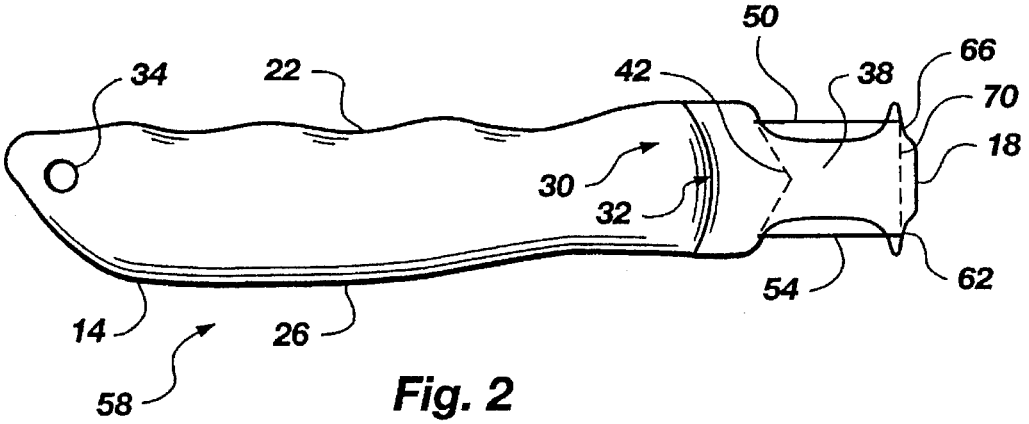
FIG. 2 is a top view of an alternative embodiment of the inventive sharpening device having cut down portions of the engagement end and having a single notch in the plate.

Turning to FIG. 2 an alternative embodiment of the present invention is illustrated generally at 58. This embodiment incorporates a deburring side tapered portion 62 on engagement end 18. Deburring side tapered portion 62 is located on the same side of sharpening device 58 as curved portion 26 and deburring edge 54. Deburring side tapered portion 62 allows a user to maneuver in tighter spaces to debur a blade or blade-like surface prior to sharpening.

Also depicted is sharpening side tapered portion 66. Sharpening side tapered portion 66 is disposed on the same side of sharpening device 58 as ridges 22 and sharpening edge 50. Sharpening side tapered portion 66 allows a user to maneuver in tighter spaces to sharpen a blade or blade like surface in a manner similar to deburring side tapered portion 62.

An alternative configuration of plate 38 is also illustrated. In this configuration, plate 38 incorporates handle end notch 42 and engagement end flat edge 70. As shown, engagement end flat edge 70 does not incorporate a notch. Here in this configuration, handle end notch 42 is the only notch employed to act against the forces present in use of sharpening device 58.

Figure 3:
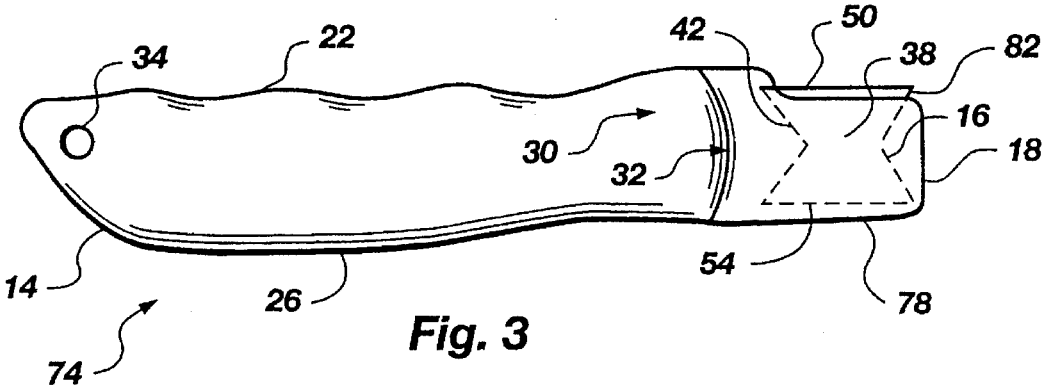
FIG. 3 is a top view of an alternative embodiment of the inventive sharpening device having only one exposed engagement edge.

Turning to FIG. 3 another alternative embodiment of the present invention is shown generally at 74. In this embodiment, only sharpening edge 50 is exposed. Deburring edge 54 is not exposed. Rather, deburring edge 54 is enclosed in the material of the body of sharpening device 74 at engagement end 18.

In this configuration, engagement end 18 incorporates housing 78 by extending the material along the side of curved portion 26 such that deburring edge 54 is enclosed rather than exposed. This configuration provides only one sharpening surface and may be particularly advantageous in applications where deburring is of little or no importance. The addition of housing 78 may also provide additional stability of sharpening edge 50 during use.

Also illustrated in this embodiment is the fact that engagement end notch 46 of plate 38 need not be disposed entirely within the material of the body of sharpening device 74. Here corner 82 of plate 38 of engagement end notch 46 is left exposed. It will be appreciated that only a portion of any notch need be enclosed within the material of the body of sharpening device 74 in order to provide stability and rigidity of plate 38 during use in sharpening a blade or blade-like surface of an implement.

Figure 4:
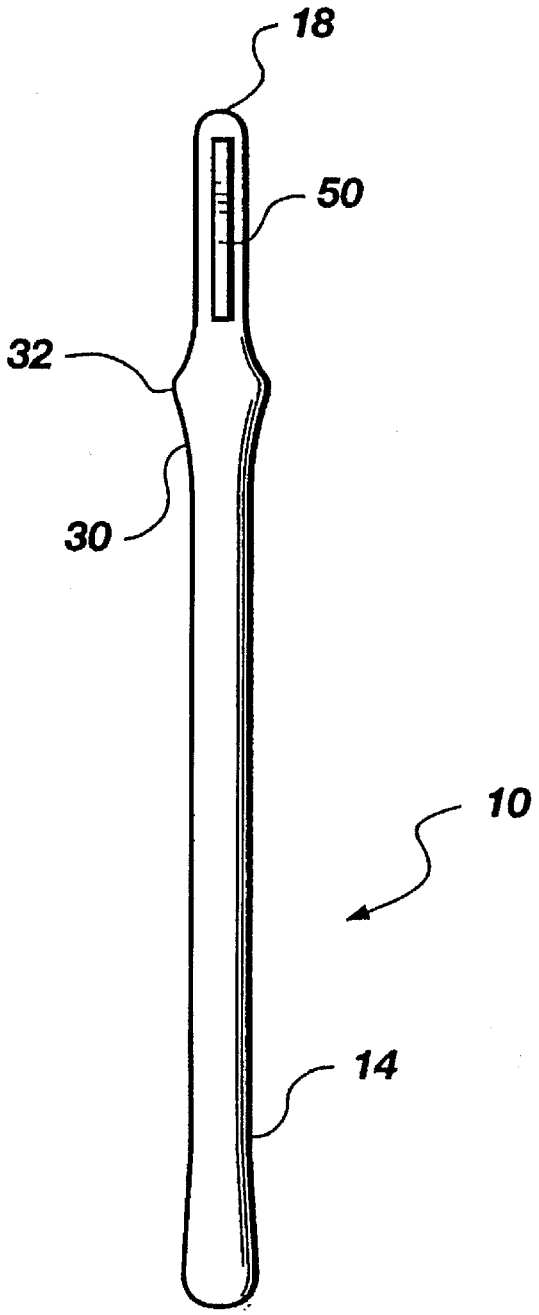
FIG. 4 is a side view of the implement sharpening device of the present invention as shown in top view in FIG. 1.

Turning to FIG. 4, a side view of the present invention, as depicted in top view in FIG. 1, is shown. Here, the surface of sharpening edge 50 is depicted. Also illustrated is dished area 30. As will be appreciated, a user can position a thumb on dished area 30 pressing against raised ridge 32 to gain added stability of sharpening device 10 during use.

The invention may be embodied in other specific forms without departing from its spirit or essential characteristics. The described embodiments are to be considered in all respects only as illustrative and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. An implement sharpening device comprising:

a body member having a handle end and an engagement end;

a plate having a composition and engagement surface configuration useful for sharpening a steel blade, said plate being positioned at said engagement end and partially enclosed within said body member such that the engagement surface is exposed;

said plate having at least one notch therein, said notch being at least partially disposed within said body member such that portions of said body member extend into the notch so as to hold said plate in a substantially rigid position with respect to said body member;

a curved plurality of ridges disposed along said handle end thereby providing a finger grip;

a curved portion disposed along said handle end opposite said ridges thereby contouring to the palm of the hand of a user;

a dished area disposed at the joining of said handle end and said engagement end thereby providing an area for placement of the thumb of a user; and a raised ridge disposed along one side of said dished area so as to provide bracing for the thumb of a user.

2. An implement sharpening device as defined in claim wherein corner portions of the engagement end of the body member further comprise at least one tapered portion disposed near a distal juncture of the engagement end and the exposed engagement surface thereby to provide maneuverability for applying the engagement surface in tight spaces.

3. An implement sharpening device as defined in claim 1 wherein said plate is manufactured of solid carbide material.

4. An implement sharpening device comprising:

a body member having a handle end and an engagement end;

a plate having a composition and engagement surface configuration useful for sharpening a steel blade, said plate further including a deburring engagement surface opposite the sharpening engagement surface, said plate being positioned at said engagement end and partially enclosed within said body member such that the sharpening engagement surface and deburring engagement surface are exposed;

said plate having at least one notch therein, said notch being at least partially disposed within said body member such that portions of said body member extend into the notch so as to hold said plate in a substantially rigid position with respect to said body member;

a curved plurality of ridges disposed along said handle end thereby providing a finer grip;

a curved portion disposed along said handle end opposite said ridges thereby contouring to the palm of the hand of a user;

a dished area disposed at the joining of said handle end and said engagement end thereby providing an area for placement of the thumb of a user; and a raised ridge disposed along one side of said dished area so as to provide bracing for the thumb of a user.

5. An implement sharpening device as defined in claim 4, wherein corner portions of the engagement end of the body member further comprise a tapered portion disposed near a distal juncture of the engagement end and the deburring engagement surface thereby to provide maneuverability for applying the engagement surface in tight spaces.

6. An implement sharpening device comprising:

a body member having a handle end and an engagement end;

a plate having a composition and engagement surface configuration useful for sharpening a steel blade, said plate being positioned at said engagement end and partially enclosed within said body member such that at least one engagement surface is exposed;

said plate having a first notch and a second notch, said notches being positioned on opposite edges of said plate thereby providing a butterfly configuration and, said notches being disposed at least partially within said body member such that portions of the body member extend into both of the notches so as to hold said plate in a substantially rigid position with respect to said body member;

a curved plurality of ridges disposed along said handle end thereby providing a finger grip;

a curved portion disposed along said handle end opposite said ridges thereby contouring to the palm of the hand of a user;

a dished are disposed at the joining of said handle end and said engagement and thereby providing an area for placement of the thumb of a user; and a raised ridge disposed along one side of said dished area so as to provide bracing for the thumb of a user.

7. An implement sharpening device as defined in claim 6, wherein said plate has a first engagement surface so manufactured as to be employed in deburring an implement and a second engagement surface disposed opposite said first engagement surface so manufactured as to be employed in sharpening an implement.

8. An implement sharpening device as defined in claim 6 wherein said first and second notches are disposed such that the deepest part of said notches is aligned along the long axis of said body member.

9. An implement sharpening device as defined in claim 8 wherein said engagement end of said body member extends to the most distal point from said handle end, thereby maximizing the resistance of said body member to movement of said plate.

10. An implement sharpening device as defined in claim 8 wherein the most distal position lies on the long axis of said body member.

11. An implement sharpening device as defined in claim 6 wherein said body member enclosing said plate is so sized and configured as to form an annular housing around said plate.

12. An implement sharpening device comprising:

a body member having a handle end and an engagement end;

a plate having a composition and engagement surface configuration useful for sharpening a steel blade, said plate being positioned at said engagement end and partially enclosed within said body member such hat the engagement surface is exposed;

said plate having at least one notch therein, said notch being at least partially disposed within said body member such that portions of said body member extend into the notch so as to hold said plate in a substantially rigid position with respect to said body member;

wherein the engagement surface comprises a side of the plate, said plate further including a proximal end and an opposing distal end, wherein the plate is enclosed in such a manner that the body member circumscribes the plate around said proximal and distal ends such that at least a portion of said distal end is covered by the body member.

13. An implement sharpening device as defined in claim 1, wherein the notch comprises a V-shaped notch.

14. An implement sharpening device comprising:

a body member having a handle end and an engagement end;

a plate having a composition and engagement surface configuration useful for sharpening a steel blade, said plate being positioned at said engagement end and partially enclosed within said body member such that the engagement surface is exposed;

said plate having at least one notch therein, said notch being at least partially disposed within said body member such that portions of said body member extend into the notch so as to hold said plate in a substantially rigid position with respect to said body member;

wherein the engagement surface comprises a side of the plate, said plate further including a proximal end and an opposing distal end and first and second notches formed in said proximal and distal ends, respectively, wherein said notches are both at least partially disposed within the body member such that portions of said body member extend into said first and second notches.

15. An implement sharpening device comprising:

a body member having a handle end and an engagement end;

a plate having a composition and engagement surface configuration useful for sharpening a steel blade, said plate further including a deburring engagement surface opposite the sharpening engagement surface, said plate being positioned at said engagement end and partially enclosed within said body member such that the sharpening engagement surface and deburring engagement surface are exposed; and said plate having at least one notch therein, said notch being at least partially disposed within said body member such that portions of said body member extend into the notch so as to hold said plate in a substantially rigid position with respect to said body member;

wherein the sharpening engagement surface comprises a side of the plate, said plate further including a proximal end and an opposing distal end, wherein the plate is enclosed in such a manner that the body member circumscribes the plate around said proximal and distal ends such that at least a portion of said and distal end is covered by the body member.

16. An implement sharpening device comprising:

a body member having a handle end and an engagement end;

a plate having a composition and engagement surface configuration useful for sharpening a steel blade, said plate being positioned at said engagement end and partially enclosed within said body member such that at least one engagement surface is exposed; and said plate having a first notch and a second notch, said notches being positioned on opposite edges of said plate thereby providing a butterfly configuration and, said notches being disposed at least partially within said body member such that portions of the body member extend into both of the notches so as to hold said plate in a substantially rigid position with respect to said body member;

wherein the engagement surface comprises a side of the plate, said plate further including a proximal end and an opposing distal end, wherein the plate is enclosed in such a manner that the body member circumscribes the plate around said proximal and distal ends such that at least a portion of said distal end is covered by the body member.

17. An implement sharpening device comprising:

a body member having a handle end and an engagement end;

a plate having a composition and engagement surface configuration useful for sharpening a steel blade, said plate being positioned at said engagement end and partially embedded within said body member such that the engagement surface is exposed;

wherein the engagement surface comprises a side of the plate, said plate further including a proximal end and an opposing distal end, wherein the plate is embedded in such a manner that the body member circumscribes the plate around said proximal and distal ends such that at least a portion of said distal end is covered by the body member.

* * * * *